United States Patent [19]

Fechant et al.

[11] 4,365,223

[45] Dec. 21, 1982

[54] MAGNETIC CIRCUIT

[75] Inventors: Louis J. M. Fechant, Le Vesinet; Lucien Siffroi, Versailles; Jean M. Anguille, St. Germain en Laye, all of France

[73] Assignee: La Telemecanique Electrique, France

[21] Appl. No.: 252,490

[22] Filed: Apr. 7, 1981

[30] Foreign Application Priority Data

Apr. 10, 1980 [FR] France ..... 80 08036

[51] Int. Cl.[3] ..... H01F 3/00

[52] U.S. Cl. ..... 335/281; 29/602 R

[58] Field of Search ..... 335/281, 297, 245; 339/216; 29/602 R

[56] References Cited

U.S. PATENT DOCUMENTS 2,162,465 6/1939 Guilder ..... 335/245

2,500,748 3/1950 Grant ..... 335/281

FOREIGN PATENT DOCUMENTS 1543930 10/1966 France ..... 335/281

*Primary Examiner*—Harold Broome

*Attorney, Agent, or Firm*—William A. Drucker

[57] ABSTRACT

A cylindrical core is fixed by electrical welding on an arm of a magnetic pot element, the other arms of the pot element being worked to create second polar surfaces at a predetermined distance from the first polar surface of the free end of the core, a magnetizable ring may be fixed on the end in such a manner that the first polar face is situated, after deformation, at a distance from the second polar surfaces.

4 Claims, 4 Drawing Figures

MAGNETIC CIRCUIT

BACKGROUND OF THE INVENTION

The invention relates to a magnetic circuit, for an electro-magnet, comprising a massive cylindrical core adapted to receive a winding and of which a first extremity has a surface of association which is fixed by electric welding against a bearing surface of a massive magnet pot element having arms in "L" shape or "U" shape such that the axis of the said core is perpendicular to the bearing surface, whilst a first polar surface disposed on a second extremity opposite to the first is disposed at a predetermined axial distance from a second polar surface placed at the extremity of one of the arms.

Such magnet pot elements are used to a great extent in continuous current or alternating current relays as well as in mixed excition relays which can receive windings fed either with continuous current or with alternating current.

Among the problems which are frequently met with in massive magnetic pot elements intended for relays there are those of the proper orientation of the axis of the core, and of the respecting of the distance mentioned above, and for the mixed supply pot elements that of producing them economically.

Failure to respect the geometry during manufacture, or simply making compromises results, in effect, in the absence of a correcting operation and above all in electro-magnets wherein economy of copper has been sought, in deteriorations in the forces of attraction for pulling the armature and/or in variation of the forces maintaining the armature in its working position.

It is thus necessary to give the core and the arms a perfect orientation and a precise length, and to reduce the number of correcting operations which may be required.

THE PRIOR ART

In certain known constructions, the core is fixed on a pot element by an upsetting operation which can modify the length of this core and change the initial orientation given to the two pieces to be joined together; furthermore, parasitic gaps can appear in the region of their join.

In other cases, it has been proposed to fit by force the end of the core into a recess formed in the pot element, which makes it necessary to adhere very strictly to the working conditions necessary to ensure the regularity of fixing in the course of bulk manufacture.

Finally it has been proposed to fix, by electric welding, the end of the core on the pot element to which it must be secured in a permanent manner, without nevertheless paying particular attention to projections of fused metallic particles which are produced locally and which often serve to prevent the body of the winding seating itself completely onto the core; furthermore, when no particular precaution, most often costly, is taken to guide and move the core rigorously in the course of the fusion and forging of the metal in the region of the weld, the two pieces once they are welded can have dispositions which are unsatisfactory both as to dimensions and as to orientation.

If a magnetic pot element manufactured according to one of the methods disclosed above is intended for electro-magnets fed either with continuous current or with alternating current, it is well known that alterations must be made to the polar surface placed at the second free extremity of the core and cooperating with the movable armature in order to provide gaps which can be satisfactory in each case for the different conditions of attraction for stroking and maintaining mentioned above; generally, there is provided on the second extremity of a core receiving a winding fed with continuous current, an enlargement of annular form having a diameter greater than that of the core, whilst this extremity is left in its original state when it is a question of a winding fed with alternating current.

The production of this enlargement, if it is not provided in one piece with the core, can be carried out in various ways, but there are only really useful those fixing methods which do not give rise to a geometric distortion of the dimensions produced after welding; consequently, a method of plastic deformation of the free extremity must generally be avoided, when the methods of fixation described above have not been able to provide, from the start, an absolutely rigorous geometrical disposition for the two elements of the magnetic pot element.

OBJECT OF THE INVENTION

The invention thus proposes to provide a magnetic circuit such as is defined hereinabove but in which steps are taken so that a core fixed by electrical welding on a pot element will take up a geometrical disposition which conforms rigorously to that which is intended, in the course of repeat manufacture, in order that subsequent mechanical operations carried out on the free end of the core will not produce any deformation of the initial geometry.

SUMMARY OF THE INVENTION

According to the invention, this result is obtained in that the bearing surface is a plane surface, disposed below an internal surface of the element of the pot, which possesses a dimension measured parallel to this internal surface which is slightly greater than the diameter of the core, and in that before welding a cylindrical opening with axis perpendicular to the bearing surface and of a chosen diameter enters the said pot element to a predetermined depth, and the said first extremity has a frusto-conical lug the curved surface of which constitutes the surface of association, this lug having a base the maximum diameter of which is greater tha the chosen diameter of the opening and a height less than the depth of the opening and in that a transverse annular stop surface adapted to cooperate after welding with the bearing surface is disposed between the said base and the external surface of the core.

The invention will be better understood from reading of the following description.

DESCRIPTION OF THE PREFERRED EMBODIMENT

Figure 1:
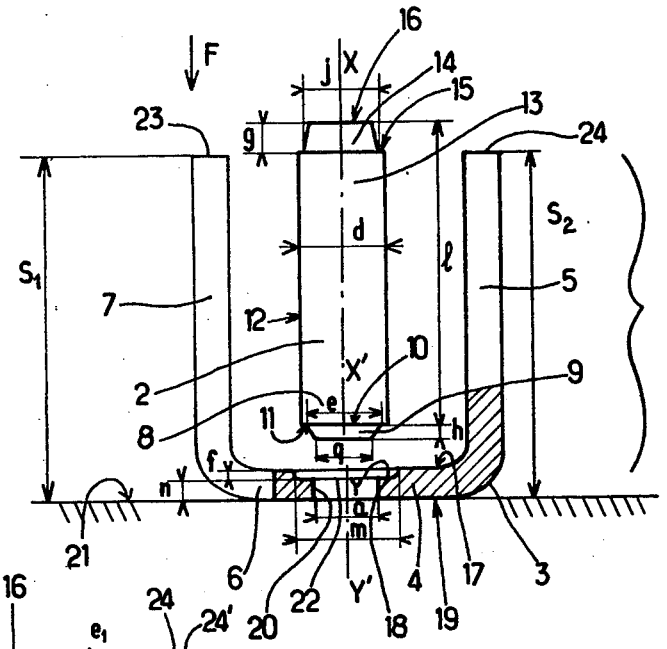
FIG. 1 shows the two elements of the magnetic circuit before their association together.

Two elements, the assembly of which will constitute the fixed magnetic circuit 1 of an electro-magnet, are seen before this operation in FIG. 1, wherein a massive core 2 of cylindrical shape is placed opposite to a likewise massive magnet pot 3; this magnet pot 3 can assume one of two shapes as an "L", shown in thick lines, or as a "U" shown in thin lines, obtained by bending for example, and accordingly comprises either a small arm 4 and a large arm 5, or a cross-piece 6 similar to the small arm and coupled to two parallel large arms 5 and 7.

After bending, terminal and transverse surfaces 24, 23 situated at the free ends of the arms 7 and 5 respectively are disposed at substantially identical distances $s_1$ and $s_2$ from a lower and external face 19 of the element 4.

The cross-piece or the small arm, and the large arms, are generally perpendicular to each other and the axis XX' of the core 2 will be parallel to a large arm after assembly, and thus perpendicular to the external face 19.

The core 2, which has a diameter d has at a first end 8 a lug 9 of frusto-conical shape having a base 10 of diameter e less than d and a height h.

An annular stop surface 11, which is preferably perpendicular to the axis XX', is disposed between the base and the external surface 12 of the core.

The core has at a second extremity 13 opposite to the first a frusto-conical lug 14 of diameter j and a transverse surface 15, analogous to those which have just been described for the first extremity; nevertheless, the height g of this lug will preferably be greater than h, and its apex angle will be different.

A distance l separates the stop surface 11 from a first plane polar face 16 which terminates the lug 14.

The magnet pot, constituted by the small arm 4, or cross-piece 6, comprises on its internal face 17 a plane bearing surface 18 which is situated below the internal face 17, from which it is spaced by a dimension f; this bearing surface, the dimension m of which measured parallel to the plane of the surface 17 is greater than the diameter d, is plane and parallel to the external surface 19 opposite to 17, from which it is spaced by the distance n; it can be produced by cutting or pressing.

Figure 4:
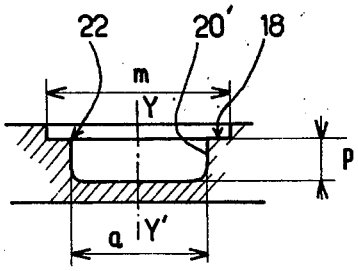
FIG. 4 shows a modified construction of the magnet pot.

Finally, a cylindrical opening 20 or 20', with an axis YY' perpendicular to the surface 18, of diameter a less than e and greater than diameter g of the end of the lug, passes through the pot element 4 of enters it to a depth p measured from the surface 18 as a blind hole, see also FIG. 4.

In the course of the process which carries out, by electric welding, the assembly of the core and of the magnet pot, this latter is pressed by its external surface 19 against a work table or support 21, a welding apparatus, terminated for example by an electrically conductive gripper, suppots a core 2 by its end 13 in such a manner that its axis XX' coincides substantially with the axis YY' of the opening 20 and performs a descending movement in the direction of the arrow F until the moment when the lug 9 is engaged in the opening; if a slight offsetting exists between the axes XX' and YY', the cooperation of the conical surface of the lug and the opening entrance 22 will cause alignment of these two axes.

In every case, the height n of a through-hole or the depth p of a blind hole (not shown in FIG. 1) will be greater than the height h of the lug.

In the course of the operation of electrical welding proper, a current will circulate through the core and the magnet pot, and will produce a fusion of metal localised at the entry 22 of the opening 20 and at the curved surface of association 25 of the lug which is in contact with it; when the metal achieves a suitable fluidity, and when the current is cut, a forging phase, consisting of applying to the core a force in the direction of the arrow F, will cause a plastic deformation of the lug and of the entrance of the opening which will continue up to the moment when the annular stop surface 11 of the lug becomes pressed against the bearing surface 18.

Figure 2:
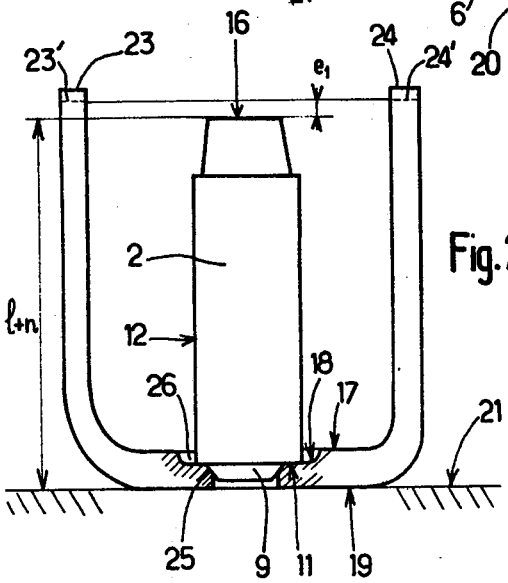
FIG. 2 shows a complete magnetic circuit when it is intended to receive a winding fed with alternating current.

Droplets of fused metal or metallic particles which appear in the course of the operation of welding will gather in the annular space 26 which exists between the external surface 12 of the end 8 of the core, the bearing surface 18 and the upper face 17, see FIG. 2.

When the welding operation is terminated and the assembled elements are in the condition seen in FIG. 2, the first plane polar face 16 is found to be situated at a height l+n with respect to the table 21, or to the external face 19.

Figure 3:
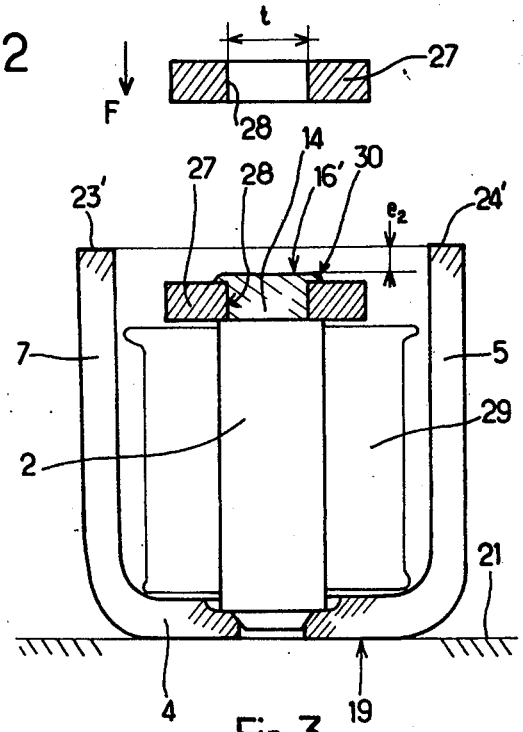
FIG. 3 shows a complete magnetic circuit when it is intended to receive a winding fed with continuous current.

If such a circuit, which in fact constitutes a blank suitable for inclusion both in an alternating current relay or in a continuous current relay, is intended for use in an alternating current relay, the predetermined axial distance mentioned above must have, when the magnetic circuit is completed, a value $e_1$, whereas in the other case of a continuous current, this predetermined distance must have a value $e_2$ greater than $e_1$ when a polar enlargement has been fixed on the second extremity, see FIG. 3.

The dimensions $s_1$, $s_2$ and l+n are chosen in order that the difference between these two pairs of dimensions are very close to the predetermined value $e_1$ mentioned above, in such a manner that a supplementary operation of levelling of the terminal surfaces 23, 24 will have to be carried out to obtain it; this operation is carried out by a correction which takes, as its plane of reference, the position of the upper surface 16 of the core and which consequently only removes a small quantity of material on the ends of the arms 5 and 7 to create second polar faces 23', 24' of a machined nature.

When it is intended to use a magnetic circuit for the production of a continuous current relay, use is made of a magnetic circuit which has already been machined for an alternating current relay and the core thereof is equipped firstly with an appropriate winding 29 and then, at its second end 14, with a ring 27 intended to form the polar enlargement which is necessary in this case, see FIG. 3.

This ring which, before fixing, has a cylindrical opening 28 with a diameter t less than the diameter j of the base of the lug 14, is fitted over this latter and is finally fixed by an upset or flanging 30.

In the course of this operation, which must create a first plane polar face 16' which is deformed and placed at an axial distance $e_2$ from the second polar faces 23', 24', the forming tool for this surface has, at its plane of reference, the existing second faces 23' and 24', see FIG. 3; by reason of the good seating and the good disposition of the core, there is no parasitic geometrical deformation of the core observed in the course of this operation.

Naturally, the nature of the materials selected for the manufacture of the magnet pot, the core and the ring will take into account the conditions to which these elements will be submitted, both from the point of view of their magnetic properties and of their mechanical properties.

We claim:

1. A process for manufacturing an electro-magnet magnetic circuit comprising a U or L-shaped massive magnet yoke having a cross-piece and least one arm substantially at right angles to the cross-piece, and a cylindrical elongated core mounted on said cross-piece and extending in a direction substantially parallel to said arm, said process comprising the steps of:

(a) shaping the said core with, at a first end thereof, a frusto-conical end portion having a larger base diameter which is smaller than the diameter of the core, whereby a plane transverse annular stop surface is formed between the cylindrical outer surface of the core and the base of the frusto-conical end portion, and with, at the opposite end of the said core, a further plane transverse surface, (b) shaping the said cross-piece with a cavity having lower and upper substantially cylindrical coaxial portions, the lower portion having a depth larger than the heigth of the frusto-conical end portion and a diameter smaller than the said larger base diameter and larger than the smaller diameter of the said frusto-conical end portion and the upper portion opening at the inner surface of the cross-piece and having a diameter which is larger than the diameter of the core, a bearing annular plane surface portion, parallel to the said outer surface and located at a predetermined distance from the said outer surface, connecting the cylindrical surfaces of the said upper and lower portions of the cavity;

(c) positioning the yoke with the outer surface of the cross-piece lying on a plane support member and positioning the core in a direction substantially at right angles with the cross-piece and with the smaller base of said frusto-conical end portion substantially located in the plane of the said bearing annular surface portion and coaxially located with respect to the said cavity;

(d) translating the core in a direction substantially at right angles with the said outer surface of the cross-piece until the said stop surface of the core abuts against the said bearing surface portion of the cavity and simultaneously establishing an electric welding voltage across the core and the yoke for producing a local fusion and, consequently, a plastic deformation of the core at the said frusto-conical end portion and of the cross-piece at the said cavity;

(e) levelling of the end surface of the said arm remote from the cross-piece to form a plane polar surface substantially parallel to the said further plane polar surface of the core located at a predetermined distance from said further plane polar surface.

2. A process for manufacturing an electro-magnet magnetic circuit as claimed in claim 4, said magnetic circuit being adapted for use in a direct-current relay, the said process further comprising the steps of:

(f) fitting a magnetic ring over the core at the said opposite end thereof and (g) securing the said ring by forming a flange at the said opposite end of the core through a step of lateral and axial deformation of the said opposite end performed in such a manner as to form a plane polar surface at the said opposite end which is located a predetermined distance from said plane polar surface of the said arm by using the said plane polar of the arm as a reference surface for the said step of deformation.

3. An electro-magnet magnetic circuit as obtained by means of the process of claim 1.

4. An electro-magnet magnetic circuit as obtained by means of the process of claim 2.

* * * * *